US009127591B2

(12) United States Patent
Arima et al.

(10) Patent No.: US 9,127,591 B2
(45) Date of Patent: Sep. 8, 2015

(54) ENGINE SUPERCHARGER DRIVE DEVICE

(75) Inventors: Hisatoyo Arima, Akashi (JP); Yoshinobu Tanaka, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 13/441,737

(22) Filed: Apr. 6, 2012

(65) Prior Publication Data

US 2012/0186565 A1 Jul. 26, 2012

Related U.S. Application Data

(63) Continuation of application No. PCT/JP2010/067832, filed on Oct. 12, 2010.

(30) Foreign Application Priority Data

Oct. 14, 2009 (JP) ..... 2009-236995

(51) Int. Cl.

| | |
|---|---|
| ***F02B 33/00*** | (2006.01) |
| ***F02B 33/40*** | (2006.01) |
| ***F02B 39/04*** | (2006.01) |
| *F02D 41/00* | (2006.01) |

(52) U.S. Cl.

CPC ..... *F02B 33/40* (2013.01); *F02B 39/04* (2013.01); *F02D 41/0007* (2013.01); *F02D 2200/101* (2013.01)

(58) Field of Classification Search

CPC ..... F02B 37/105; F02B 39/04; F02B 39/06; F02B 39/08; F02B 39/12

USPC ..... 123/65 BA, 559.1, 561, 559.3; 74/331, 74/329, 333

See application file for complete search history.

(56) References Cited

U.S. PATENT DOCUMENTS

| | | | | | |
|---|---|---|---|---|---|
| 1,791,393 | A | * | 2/1931 | Viale | 475/297 |
| 1,977,553 | A | * | 10/1934 | Halford | 475/52 |
| 2,080,079 | A | * | 5/1937 | Johnson | 74/363 |
| 2,082,556 | A | * | 6/1937 | Smith et al. | 74/357 |

(Continued)

FOREIGN PATENT DOCUMENTS

| | | |
|---|---|---|
| CN | 200978709 | 11/2007 |
| JP | 57-020516 | 2/1982 |

(Continued)

OTHER PUBLICATIONS

JP 57020516 A English Translation dated Jul. 2013.*

(Continued)

*Primary Examiner* — Audrey K Bradley
*Assistant Examiner* — Jason T Newton

(57) ABSTRACT

A supercharger drive device (1) for a combustion engine (E) includes a gear carrier shaft (6) operable to rotate in unison with a crankshaft (2) of the combustion engine (E), a high speed gear (8) and a low speed gear (10) provided in the gear carrier shaft (6), a drive shaft (14) of a supercharger (12) which is rotatable when coupled with either one of the high speed gear (8) and the low speed gear (10), a gear shifter (16) for selecting one of the high speed gear (8) and the low speed gear (10) for transmitting a motive force from the gear carrier shaft (6) to the drive shaft (14) through the selected one of the high and low speed gears (8) and (10), and a shifter drive unit (18) for actuating the gear shifter (16) in dependence on the rotational speed of the combustion engine (E).

14 Claims, 5 Drawing Sheets

(56) References Cited

U.S. PATENT DOCUMENTS

| | | | | | |
|---|---|---|---|---|---|
| 2,099,675 | A * | 11/1937 | Cutler | 475/286 |
| 2,139,986 | A * | 12/1938 | Towns et al. | 475/286 |
| 2,197,179 | A | 2/1939 | Hersey | |
| 2,187,737 | A * | 1/1940 | Gregory | 123/561 |
| 2,242,374 | A * | 5/1941 | Schultz et al. | 417/223 |
| 2,263,453 | A * | 11/1941 | Browne | 475/302 |
| 2,400,307 | A * | 5/1946 | Hobbs et al. | 123/561 |
| 2,400,830 | A * | 5/1946 | Kinnucan et al. | 123/561 |
| 2,406,417 | A * | 8/1946 | Viviano | 74/370 |
| 5,105,793 | A * | 4/1992 | Winkelmann et al. | 123/559.1 |
| 5,256,109 | A * | 10/1993 | Winkelmann et al. | 474/28 |
| 5,443,054 | A * | 8/1995 | Tateno et al. | 123/559.1 |
| 6,568,376 | B2 * | 5/2003 | Sonnleitner et al. | 123/559.1 |
| 2002/0096156 | A1 * | 7/2002 | Palazzolo et al. | 123/559.1 |
| 2007/0068465 | A1 * | 3/2007 | Wolfsgruber et al. | 123/1 A |
| 2009/0139231 | A1 * | 6/2009 | Eberle et al. | 60/624 |
| 2009/0173318 | A1 * | 7/2009 | Grethel et al. | 123/561 |
| 2009/0293850 | A1 * | 12/2009 | Wilflinger et al. | 123/559.3 |
| 2011/0048000 | A1 * | 3/2011 | Kley et al. | 60/598 |

FOREIGN PATENT DOCUMENTS

| | | | | |
|---|---|---|---|---|
| JP | 57020516 | A * | 2/1982 | F02B 37/04 |
| JP | 02-016330 | | 1/1990 | |
| JP | 02-24284 | | 1/1990 | |
| JP | 02006289 | A * | 1/1990 | B62M 7/02 |
| JP | 02-070920 | | 3/1990 | |
| JP | 3-500319 | | 1/1991 | |
| JP | 3-15781 | | 4/1991 | |
| JP | 5-30433 | | 4/1993 | |
| JP | 05-086951 | | 4/1993 | |
| JP | 05086951 | A * | 4/1993 | F02D 43/00 |
| JP | 2632903 | | 4/1997 | |
| JP | 2000-230614 | | 8/2000 | |
| JP | 2001-187913 | | 7/2001 | |
| JP | 2002-005236 | | 1/2002 | |
| JP | 2002-242687 | | 8/2002 | |
| WO | WO 89/02535 | | 3/1989 | |

OTHER PUBLICATIONS

Translation of JP 02006289 A, Jan. 2015, entire document.*
Translation of JP 02070920 A, Jan. 2015, entire document.*
Translation of JP 02024284 A, Jan. 2015, entire document.*
PCT Application No. PCT/JP2010/067832 International Preliminary Report and Written Opinion dated May 24, 2012, 6 pages.
European Application No. 10823364.4 Extended European Search Report dated Oct. 4, 2013, 5 pages.
Chinese Application No. 201080045706.X Office Action dated Sep. 9, 2013, 9 pages including partial English translation.
Japanese Application No. 2011-536129 Office Action dated Nov. 4, 2014, 4 pages with partial English translation.
Japanese Application No. 2013-166231 Office Action dated Nov. 4, 2014, 4 pages with partial English translation.

* cited by examiner

ENGINE SUPERCHARGER DRIVE DEVICE

CROSS REFERENCE TO THE RELATED APPLICATION

This application is a continuation application, under 35 U.S.C. §111(a) of international application No. PCT/JP2010/067832, filed Oct. 12, 2010, which claims priority to Japanese patent application No. 2009-236995, filed Oct. 14, 2009, the entire disclosure of which is herein incorporated by reference as a part of this application.

BACKGROUND OF THE INVENTION

1. Field of the Invention

The present invention relates to a supercharger drive device for variable transmission of a supercharger driven by a combustion engine.

2. Description of Related Art

The supercharger connected with and driven by the combustion engine has such a tendency that if it is adjusted to be suitable for a low-to-medium speed region, the supercharged pressure (the amount of charged air) in a high speed region will increase too much, but if it is adjusted to be suitable for the high speed region the supercharged pressure in the low-to-medium speed region will become insufficient. The patent document listed below discloses the drive device operable to switch the supercharger, which is operatively linked with a transmission connected with the combustion engine, on or off in dependence of a gear shifting of the transmission. The drive device disclosed in the patent document has, however, been found having such a problem that the change gear ratio of the supercharger itself remains constant and is therefore insufficient.

PRIOR ART LITERATURE

[Patent Document] JP Laid-open Utility Model Publication No. H5-30433

SUMMARY OF THE INVENTION

The present invention has been devised to substantially eliminate the foregoing problems and inconveniences inherent in the prior art and is intended to provide a supercharger drive device of a type, in which a change gear ratio of the supercharger can be selected in dependence on the number of revolutions, or rotational speed, of the combustion engine.

In order to accomplish the foregoing object of the present invention, there is provided a supercharger drive device for a combustion engine designed in accordance with the present invention includes a gear carrier shaft operable to rotate in unison with a rotary shaft of the combustion engine, a plurality of speed change gears mounted on the gear carrier shaft, a drive shaft of a supercharger connected directly or indirectly with the speed change gears for rotation, a gear shifter for selecting one of the plural speed change gears to transmit a motive force from the gear carrier shaft to the drive shaft by way of such selected one of the speed change gears, and a shifter drive unit for actuating the gear shifter in dependence on the rotational speed of the combustion engine.

According to the construction, the shifter drive unit selects one of the speed change gears by actuating the gear shifter in dependence on the rotational speed or the number of revolutions of the combustion engine and, therefore, the rotational speed of the supercharger can be adjusted to an optimum value in dependence on the rotational speed of the combustion engine.

In a preferred embodiment of the present invention, each of the speed change gears may be a speed-up gear, in which case the shifter drive unit is preferably operable to actuate the gear shifter to select one of the plural speed change gears such that the speed-up ratio becomes low with an increase of the rotational speed of the rotary shaft. This structure makes it possible to provide the optimum speed-up ratio dependent on the rotational speed of the combustion engine.

In another preferred embodiment of the present invention, the plural speed change gears may include a low speed gear and a high speed gear, both of the low and high speed gears being mounted on the gear carrier shaft for rotation relative to the latter, in which case the gear shifter is interposed between the low speed gear and the high speed gear and mounted on the gear carrier shaft for movement in a direction axially of the gear carrier shaft, but relatively non-rotatable to such gear carrier shaft, whereby upon axial movement of the gear shifter, the latter is selectively engaged with one of the low speed gear and the high speed gear for rotation together therewith.

In a further preferred embodiment of the present invention, the gear carrier shaft may be engaged with a crankshaft gear mounted on the rotary shaft for driving a balancer shaft. According to this structure, the crankshaft gear is concurrently used to drive the supercharger and therefore, an undesirable increase of the number of component parts can be suppressed. Also, the gear carrier shaft, the gear shifter and other components can be arranged with the utilization of the dead space available on one side of the crankshaft remote from the balancer shaft.

In a still further preferred embodiment of the present invention, the gear carrier shaft may be coupled with a starter through a one-way clutch. According to this structure, a change in engine torque incident to gear shifting can be absorbed by a slide friction taking place in the one-way clutch and therefore, it is possible to avoid a transmission thereof to the supercharger.

In a yet still further preferred embodiment of the present invention, the supercharger may include the drive shaft, an impeller shaft connected with the drive shaft through a planetary gear assembly, an impeller fixedly mounted on the impeller shaft, a housing for supporting the impeller shaft, and a casing fitted to the housing for enclosing the impeller, the planetary gear assembly being supported by the housing. According to this structure, the supercharger and the planetary gear assembly can be unitized together as a single unit and, therefore, an undesirable increase of assembling steps can be suppressed while an undesirable increase of the number of component parts is also suppressed. Also, since a relatively large speed-up can be obtained due to the use of the planetary gear assembly, a speed increasing machine can be compactized.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Hereinafter, the present invention will be described in detail in connection with preferred embodiments thereof with reference to the accompanying drawings.

Figure 1:
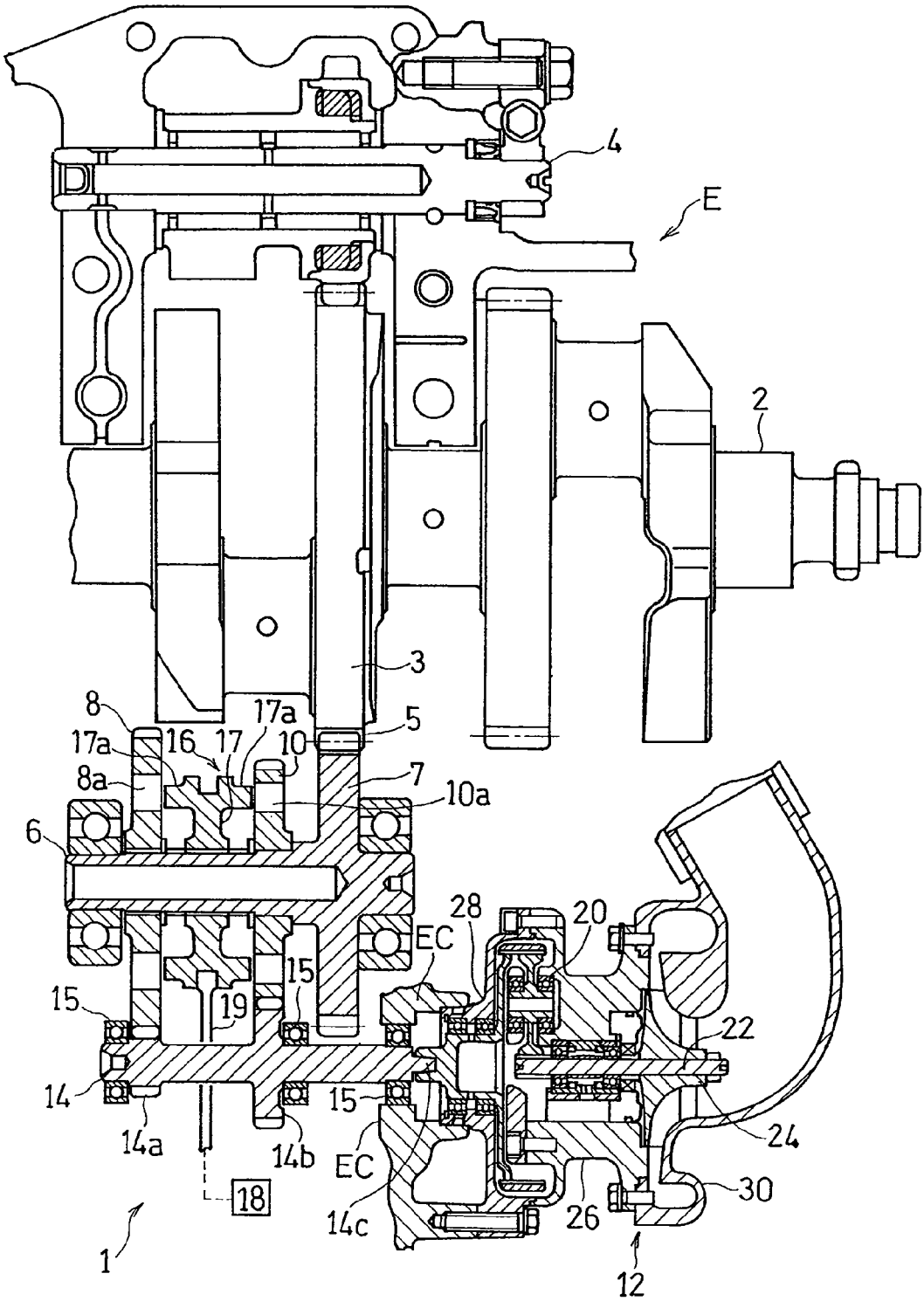
FIG. 1 is a longitudinal sectional view showing a combustion engine equipped with a supercharger drive device designed in accordance with a first preferred embodiment of the present invention.

FIG. 1 is a longitudinal sectional view showing a combustion engine E equipped with a supercharger drive device 1 designed in accordance with a first preferred embodiment of the present invention. The combustion engine E shown therein includes a crankshaft 2 which is a rotary shaft, a balancer shaft 4 disposed so as to extend parallel to the crankshaft 2, and a crankshaft gear 5 formed in an outer periphery of one of paired webs 3 of the crankshaft 2 for driving a balancer shaft 4. A gear carrier shaft 6, which is one kind of an idle shaft, is disposed on one side of the crankshaft 2 remote from the balancer shaft 4, which shaft 6 is rotatable in unison with the crankshaft 2 through an engagement of a drive gear 7, formed integrally with the gear carrier shaft 6, with the crankshaft gear 5.

The gear carrier shaft 6 is provided with a high speed gear 8 and a low speed gear 10, each of which is a kind of a speed change gear. Both of the high speed gear 8 and the low speed gear 10 are speed increasing gears and are mounted on the gear carrier shaft 6 for rotation relative to, but axially immovably relative to such gear carrier shaft 6. It is to be noted that although in the illustrated embodiment, the two speed change gears, i.e., the high and low speed gears, are shown and described as employed, three or more speed change gears may be employed.

The combustion engine E is equipped with a supercharger 12 for compressing and forcibly supplying air to the combustion engine E. This supercharger 12 includes a drive shaft 14 drivingly connected with one of the high and low speed gears 8 and 10, which have large and reduced diameters, respectively. More specifically, the supercharger drive shaft 14 has a low speed drive gear 14*a* of a reduced diameter and a high speed drive gear 14*b* of a large diameter, which are mounted on such drive shaft 14 for rotation together therewith. Those high speed gear 8, low speed gear 10, high speed drive gear 14*a* and low speed drive gear 14*b* cooperate with each other to define a speed increasing gear train. In the embodiment now under discussion, the drive shaft 14 and the gear carrier shaft 6 are connected directly with each other, but they may be connected indirectly with each other through, for example, an idle gear. While the details of the supercharger 12 will be described later, the drive shaft 14 is rotatably supported by an engine casing EC, which forms a part of an engine body, through three bearings 15.

A gear shifter 16 is interposed between the high speed gear 8 and the low speed gear 10. This gear shifter 16 is made up of a shifting drum 17 having its opposite side faces formed with first and second dogs 17*a* and 17*a* each protruding the corresponding side face of the shifting drum 17 in a direction parallel to the axial direction of the gear carrier shaft 6, and a shifting fork 19 for operating the shifting drum 17. This shifting drum 17 is so splined to the gear carrier shaft 6 that the shifting drum 17 can be axially movable along the gear carrier shaft 6, but cannot rotate independently of the gear carrier shaft 6. The shifting fork 19 referred to above is driven by a shifter drive unit 18 in the axial direction of the gear carrier shaft 6 to move the shifting drum 17 in such axial direction so that the first and second dogs 17*a* and 17*a* rigid or integral with the shifting drum 17 can be selectively engaged in engagement holes 8*a* and 10*a*, which are defined in the high speed gear 8 and the low speed gear 10, to selectively interlock the shifting drum 17 with one of the high speed gear 8 and the low speed gear 10 one at a time.

Through the selected one of the speed change gears 8 and 10, rotation of the gear carrier shaft 6 is transmitted to the drive shaft 14. In other words, when the shifting drum 17 and the high speed gear 8 are dogged together in the manner described above, the rotation of the gear carrier shaft 6, that is, the rotation of the crankshaft 2 is transmitted to the drive shaft 14 at a large speed-up ratio, but when the shifting drum 17 and the low speed gear 10 are dogged together, the rotation of the gear carrier shaft 6 is transmitted to the drive shaft 14 at a small speed-up ratio. The shifter drive unit 18 is of a type including, for example, a servo motor, but may not be necessarily limited thereto. By this shifter drive unit 18, the rotational drive of the crankshaft 2 is transmitted from the gear carrier shaft 6 to the drive shaft 14 of the supercharger 12 through the selected speed change gear 8 or 10. Those gear carrier shaft 6, high speed gear 8, low speed gear 10, drive shaft 14 of the supercharger 12, gear shifter 16 and shifter drive unit 18 altogether constitute the supercharger drive device 1 of the kind referred to previously.

Figure 2:
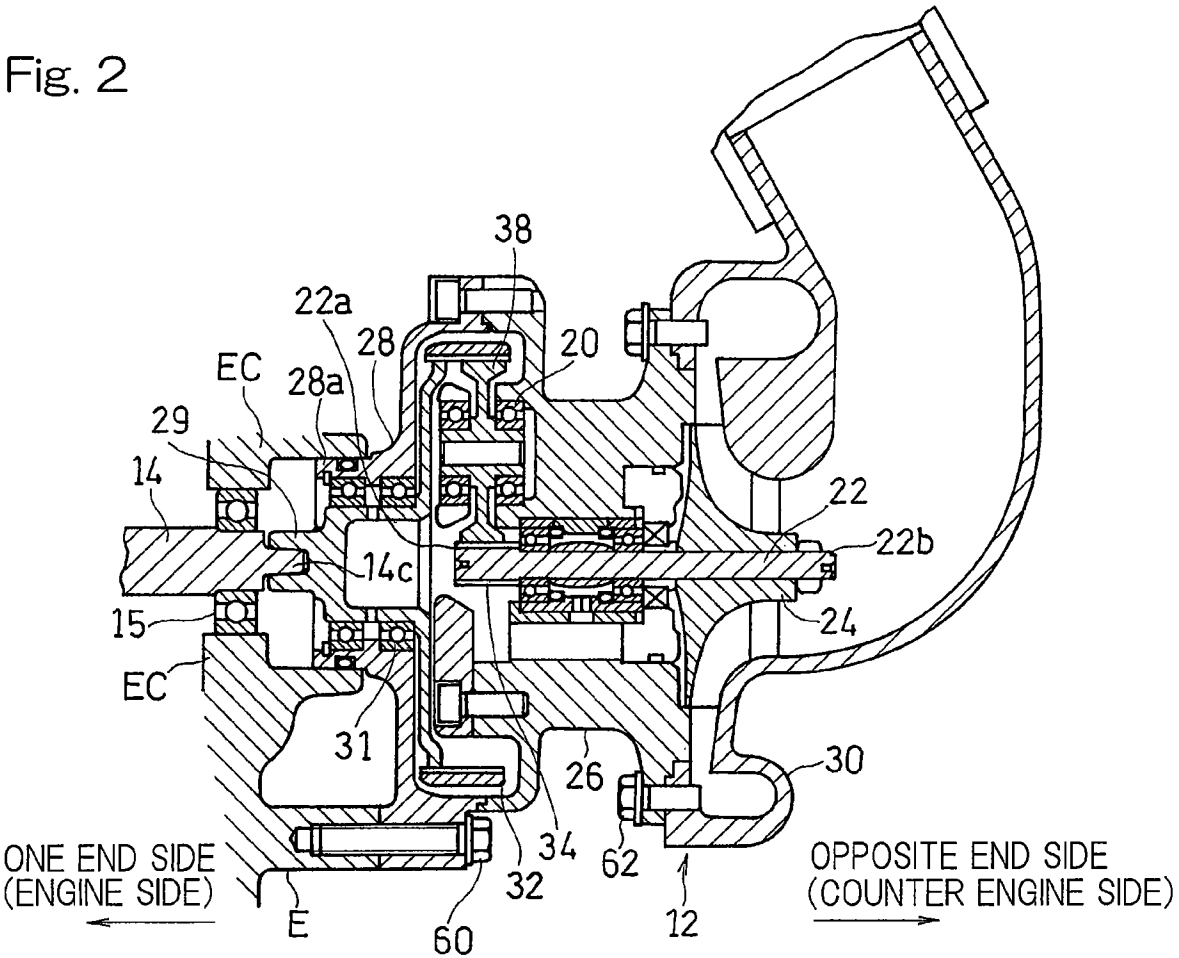
FIG. 2 is a longitudinal sectional view showing a supercharger driven by the supercharger drive device shown in FIG. 1.

The supercharger 12 is disposed outside the engine casing EC forming a part of the engine body and, as shown in FIG. 2 in a sectional view thereof, one end 14*c* of the drive shaft 14 of the supercharger 12 is connected with one end 22*a* of an impeller shaft 22 through a planetary gear assembly 20 while an impeller 24 mounted on the opposite end 22*b* of the impeller shaft 22 for rotation together therewith. Hereinafter, one end of the supercharger 12 is referred to as an engine E side and the opposite end thereof is referred to as a counter engine side.

The impeller shaft 22 is rotatably supported by a tubular housing 26. The housing 26 has one end side fixed to the engine casing EC, forming a part of the combustion engine, through an anchoring casing 28 by means of housing fastening members 60 such as, for example, bolts and also has the opposite end side to which a casing 30 for enclosing the impeller 24 is fitted with the use of a plurality of casing fastening member 62 such as, for example, bolts. In this way, a portion of the impeller shaft 22, except for that end thereof where the impeller 24 is mounted, is enclosed by the housing 26 and that portion thereof, where the impeller 24 is mounted, and the impeller 24 itself are enclosed by the casing 30. The anchoring casing 28 has a shaft support portion 28*a* supporting an input shaft 29 of the planetary gear assembly 20 through two bearings 31, and the drive shaft 14 referred to previously is relatively non-rotatably connected with the input shaft 29.

As hereinabove described, the planetary gear assembly 20 is interposed between the drive shaft 14 and the impeller shaft 22 and is supported by one end portion of the housing 26. In the embodiment shown and now under discussion, the supercharger 12 and the planetary gear assembly 20 are supported by the housing 26 to form a supercharger unit, which is in turn fitted to the engine casing EC, forming a part of the engine body, by means of the housing fastening members 60.

An internal gear 32 of a large diameter is meshed with the input shaft 29 of the planetary gear assembly 20, a plurality of planetary gears 38 are meshed with this internal gear 32, and a gear 34 mounted on one end portion 22*a* of the impeller shaft 22 as a sun gear is meshed with those planetary gears 38. Accordingly, the rotational drive of the drive shaft 14 is transmitted from the input shaft 29 of the planetary gear assembly 20 to the impeller shaft 22, which serves as an output shaft, through the internal gear 32 and the planetary gears 38.

Figure 3:
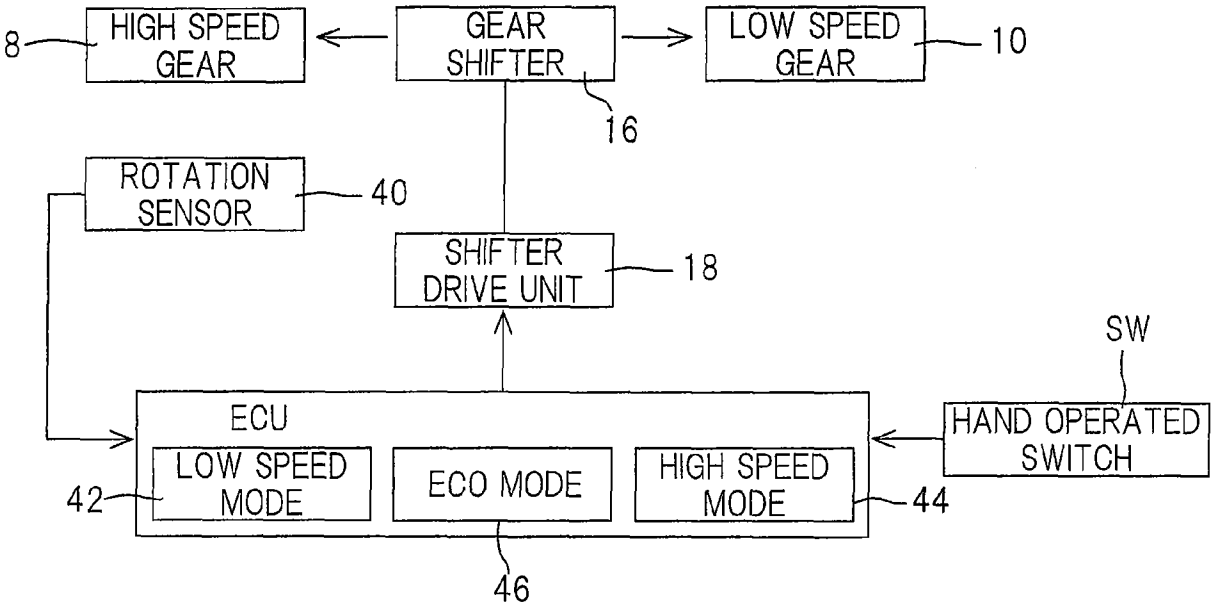
FIG. 3 is a block diagram showing an operative linkage system of various component parts of the supercharger drive device.

The gear shifter 16 of the structure described above and shown in FIG. 1 operates in the following manner. As best shown in FIG. 3, a rotation sensor 40 for measuring the rotational speed of the combustion engine E and an hand operated switch SW for manually setting an operating mode of the combustion engine E are connected with an engine control unit ECU. The shifter drive unit 18 is operable to move the gear shifter 16 in a direction axially of the gear carrier shaft 6 in dependence on the rotational speed of the combustion engine E. More specifically, the engine control unit ECU determines either a normal (low speed) mode 42 or a high speed mode 44 in reference to an increase of the rotational speed of the crankshaft 2, which is made available from the rotation sensor 40, and then control the shifter drive unit 18 so that the latter drives the gear shifter 16 to select one of the speed change gears 8 and 10, which is appropriate to one of the modes 42 and 44 which has been determined by the engine control unit ECU.

The low speed mode 42 referred to above is a mode, under which the speed-up ratio of the supercharger 12 during a predetermined low speed region of the combustion engine E is increased to increase a supercharge pressure, that is, the amount of supercharged air so that the engine torque at the low speed can be gained. Once the engine control unit ECU determines the low speed mode 42, the gear shifter 16 is dogged with the high speed gear 8. On the other hand, the high speed mode 44 referred to above is a mode, under which the speed-up ratio of the supercharger 12 during a predetermined high speed region is reduced to prevent the amount of the supercharged air from being excessive so that a proper engine torque and a stabilized rotation can be obtained. Once the engine control unit ECU determines the high speed mode 44, the gear shifter 16 is dogged with the low speed gear 10.

The engine control unit ECU controls the amount of fuel to be injected, the ignition timing and other parameters on the basis of a sensor signal, fed from the rotation sensor 40 and indicative of the rotational speed of the combustion engine E, to thereby control the rotational speed of the combustion engine E. The engine control unit ECU is also operable to increase the rotational speed of the supercharger 12 during the low speed mode 42 as hereinabove described, but to suppress the rotational speed of the supercharger 12 from becoming excessive on the basis of the sensor signal from the rotation sensor 40 during the high speed mode 44.

In addition to the determination of the operating mode in dependence on the rotational speed of the combustion engine E as hereinabove described, the operating mode can be switched even with the hand operated switch SW. Accordingly, the operator can select one of the modes at his or her will. Also, an eco mode 46 may be employed, during which the drive of the supercharger 12 is switched off. During the eco mode 46, the gear shifter 16 is held at an intermediate position at which the gear shifter 16 is engaged neither with the high speed gear 8 nor with the low speed gear 10.

Figure 4:
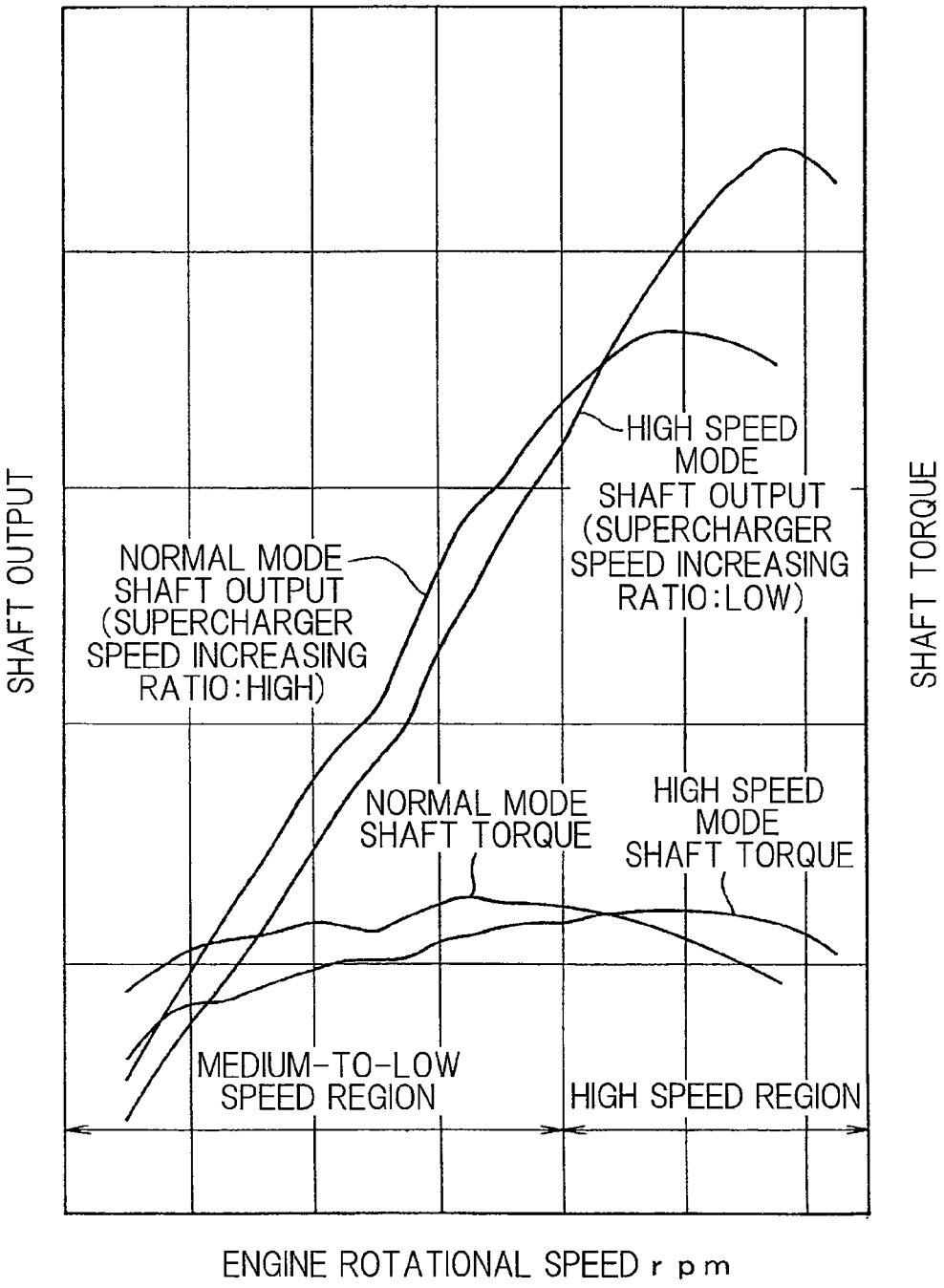
FIG. 4 is a chart showing characteristics of the supercharger drive device.

According to the embodiment, the shifter drive unit 18 shown in FIG. 1 actuates the gear shifter 16 in dependence on the rotational speed of the combustion engine E to select one of the speed change gears 8 and 10 and, accordingly, the rotational speed of the supercharger 12 can be adjusted to an optimum value in dependence on the rotational speed of the engine E. In other words, during the low speed mode 42, the gear shifter 16 is dogged with the high speed gear 8 to increase the speed-up ratio of the supercharger 12 so that control can be made to gain the engine torque during the medium-to-low speed region as shown in FIG. 4. As a result, the shaft output of the combustion engine during the medium-to-low speed region also increases.

On the other hand, during the high speed mode 44, the gear shifter 16 is dogged with the low speed gear 10 by the shifter drive unit 18 shown in FIG. 3 to reduce the speed-up ratio of the supercharger 12 so that control can be made to prevent the amount of the supercharged air during the high speed region from becoming excessive to thereby secure the proper engine torque and the stabilized revolution as shown in FIG. 4. As a result, the high shaft output of the combustion engine during the high speed region is maintained.

Also, since the crankshaft gear 5 is concurrently used to drive the supercharger 12, an undesirable increase of the number of component parts can be suppressed. In addition, the gear carrier shaft 6, the gear shifter 16 and other components can be arranged with the utilization of the dead space available on one side of the crankshaft 2 remote from the balancer shaft 4.

Yet, since the supercharger 12 and the planetary gear assembly 20 are unitized together to provide the supercharger unit, not only can the number of assembling steps be reduced while the undesirable increase of the number of component parts is avoided, but also a large speed-up can be obtained by the use of the planetary gear assembly 20 and, therefore, the supercharger drive device 1 can be downsized advantageously.

Figure 5:
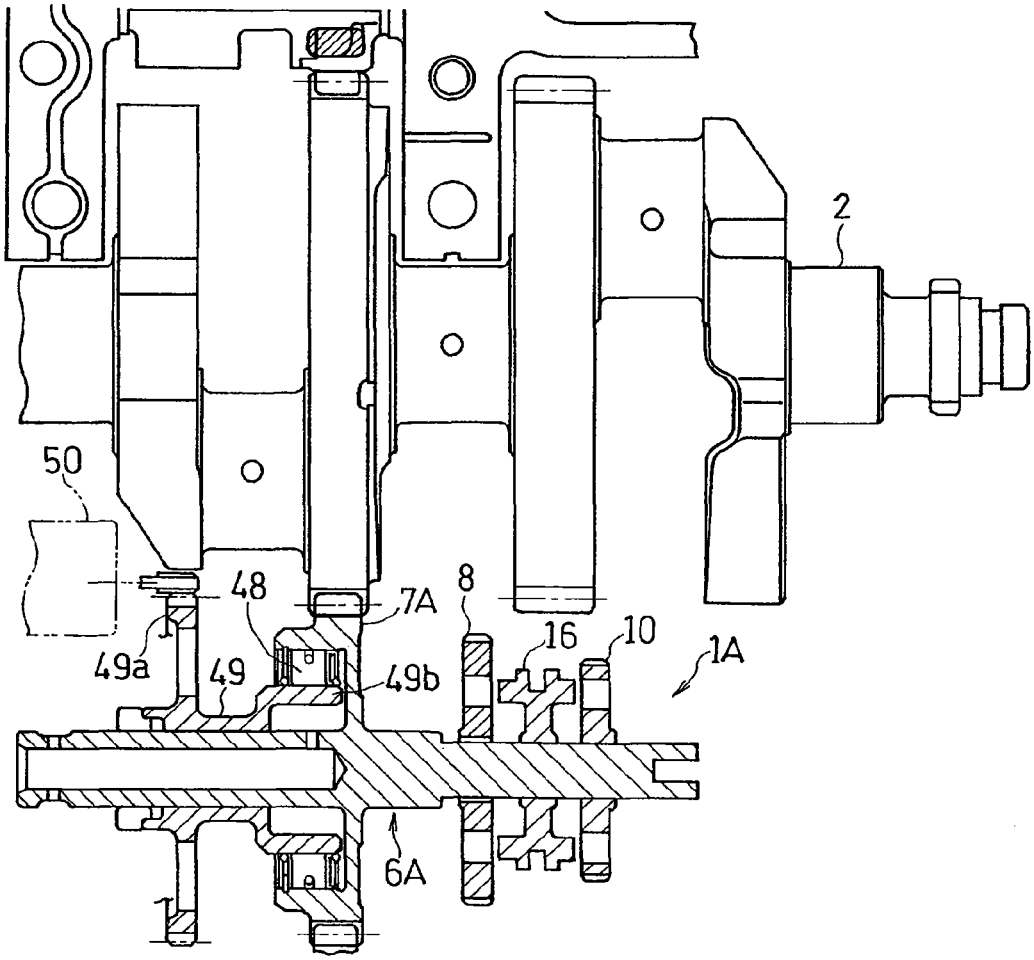
FIG. 5 is a sectional diagram showing a gear carrier shaft employed in the supercharger drive device designed in accordance with a second preferred embodiment of the present invention.

In a second preferred embodiment of the present invention, which will now be described with particular reference to FIG. 5 showing a longitudinal sectional view, the supercharger drive device now identified by 1A according to this second embodiment includes a gear carrier shaft 6A having the high speed gear 8 and the low speed gear 10 mounted thereon for rotation together therewith, and an electrically drive starter 50 is operatively coupled with the gear carrier shaft 6A through a one-way clutch 48 and a starter drum 49. The starter drum 49 is specifically mounted on an outer periphery of the gear carrier shaft 6A for rotation relative to such gear carrier shaft 6*a*, and has a starter gear 49*a* mounted on one end thereof for engagement with the electrically operated starter 50. The one-way clutch 48 referred to above is interposed between a cylindrical portion 49*b* of the other end of the starter drum 49, remote from the starter gear 49*a*, and a drive gear 7A that is formed integrally with the gear carrier shaft 6A.

According to the second preferred embodiment, only when the starter drum 49 that is driven by the electrically operated starter 50 attains a speed higher than that of the drive gear 7A, the one-way clutch 48 is brought into a coupled position to enable the transmission of the rotational force from the starter drum 49 to the drive gear 7A. Conversely, when the drive gear 7A attains a speed higher than that of the starter drum 49 subsequent to the start of the combustion engine, the one-way clutch 48 is brought into a decoupled position to interrupt the transmission of the rotational force from the drive gear 7A to the starter drum 49.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, the use may be made of a rubber damper on the drive gear 7 or 7A of the gear carrier shaft 6 to reduce an undesirable transmission of a change in engine torque to the planetary gear assembly 20.

Also, in place of the planetary gear assembly 20, the use may be made of a variable transmission for driving the supercharger 12 therethrough so that the speed-up ration can be changed in such a way as to increase the speed-up ratio at a low speed rotation but to reduce the speed-up ratio at a high speed rotation. Accordingly, a relatively high engine torque can be obtained from the low speed rotation and an undesirable occurrence of an excessive engine torque at the high speed rotation can be suppressed advantageously.

Accordingly, such changes and modifications are, unless they depart from the scope of the present invention as delivered from the claims annexed hereto, to be construed as included therein.

REFERENCE NUMERALS

1, 1A . . . Supercharger drive device
2 . . . Crankshaft (Rotary shaft)
4 . . . Balancer shaft
6, 6A . . . Gear carrier shaft
8 . . . High speed gear (Speed change gear)
10 . . . Low speed gear (Speed change gear)
12 . . . Supercharger
14 . . . Drive shaft
16 . . . Gear shifter
18 . . . Shifter drive unit
20 . . . Planetary gear assembly
22 . . . Impeller shaft
24 . . . Impeller
26 . . . Housing
30 . . . Casing
48 . . . One-way clutch
50 . . . Electrically operated starter
E . . . Combustion engine

What is claimed is:

1. A supercharger drive device for a combustion engine, which comprises:

a gear carrier shaft operable to rotate in unison with a rotary shaft of the combustion engine;

a plurality of speed change gears mounted on the gear carrier shaft;

a drive shaft of a supercharger connected directly or indirectly with the plurality of speed change gears for rotation;

a gear shifter for selecting one of the plurality of speed change gears to transmit a motive force from the gear carrier shaft to the drive shaft by way of such selected one of the plurality of speed change gears;

wherein the gear carrier shaft and the gear shifter are arranged parallel to the rotary shaft, and the gear carrier shaft has a drive gear formed integrally therewith and is rotatable in unison with the rotary shaft through an engagement of the drive gear with a rotary shaft gear formed in an outer periphery of a web of the rotary shaft.

2. The supercharger drive device for the combustion engine as claimed in claim 1, in which each of the plurality of speed change gears is a speed-up gear and a shifter drive unit is operable to actuate the gear shifter to select one of the plurality of speed change gears such that a speed-up ratio becomes low with an increase of the rotational speed of the rotary shaft.

3. The supercharger drive device for the combustion engine as claimed in claim 2, in which the plurality of speed change gears include a low speed gear and a high speed gear, both of the low and high speed gears being mounted on the gear carrier shaft for rotation relative to the latter; and in which the gear shifter is interposed between the low speed gear and the high speed gear and mounted on the gear carrier shaft for movement in a direction axially of the gear carrier shaft, but relatively non-rotatable to such gear carrier shaft, whereby upon axial movement of the gear shifter, the gear carrier shaft is selectively engaged with one of the low speed gear and the high speed gear for rotation together therewith.

4. The supercharger drive device for the combustion engine as claimed in claim 1, in which the gear carrier shaft is meshed with a crankshaft gear mounted on the rotary shaft and coupled with a balancer shaft.

5. The supercharger drive device for the combustion engine as claimed in claim 1, in which the gear carrier shaft is coupled with a starter through a one-way clutch.

6. The supercharger drive device for the combustion engine as claimed in claim 1, in which the supercharger comprises the drive shaft, an impeller shaft connected with the drive shaft through a planetary gear assembly, an impeller fixedly mounted on the impeller shaft, a housing for supporting the impeller shaft, and a casing fitted to the housing for enclosing the impeller, the planetary gear assembly being supported by the housing.

7. The supercharger drive device for the combustion engine as claimed in claim 1, wherein the rotary shaft gear drives a balancer shaft.

8. The supercharger drive device for the combustion engine as claimed in claim 4, wherein the gear carrier shaft is disposed on one side of the rotary shaft remote from the balancer shaft.

9. The supercharger drive device for the combustion engine as claimed in claim 1, further comprising a planetary gear assembly interposed between the drive shaft and an impeller shaft of the supercharger.

10. A supercharger drive device for a combustion engine, which engine includes a crankshaft, a web formed in the crankshaft, and a crankshaft gear formed in an outer periphery of the web, the supercharger drive device comprising:

a gear carrier shaft operable to rotate in unison with the crankshaft;

a plurality of speed change gears mounted on the gear carrier shaft, and a drive shaft of a supercharger connected directly or indirectly with the plurality of speed change gears for rotation, wherein the gear carrier shaft is arranged parallel to the crankshaft, the gear carrier shaft has a drive gear formed integrally therewith and is rotatable in unison with the crankshaft through an engagement of the drive gear with the crankshaft gear, rotation of the crankshaft is directly or indirectly transmitted to a drive shaft of a supercharger through the crankshaft gear in the outer periphery of the web, and the supercharger includes an impeller shaft connected with the drive shaft and an impeller fixed to the impeller shaft, configured to compress and supply air to the combustion engine.

11. A supercharger drive device of a compact configuration for a combustion engine having an engine casing with a balancer shaft and a crankshaft, which comprises:

a gear carrier shaft operable to rotate in unison with the crankshaft of the combustion engine on a side of the crankshaft remote from the balancer shaft;

a plurality of speed change gears mounted on the gear carrier shaft;

a drive shaft of a supercharger connected directly or indirectly with the plurality of speed change gears for rotation;

a gear shifter for selecting one of the plurality of speed change gears to transmit a motive force from the gear carrier shaft to the drive shaft by way of such selected one of the plurality of speed change gears; and wherein the gear carrier shaft and the gear shifter are arranged parallel to the rotary shaft, wherein the gear carrier shaft has a drive gear formed integrally therewith and is rotatable in unison with the crankshaft through an engagement of the drive gear with a crankshaft gear formed in an outer periphery of a web of the crankshaft and the crankshaft gear drives the balancer shaft.

12. The supercharger drive device for the combustion engine as claimed in claim 11, further comprising a planetary gear assembly interposed between the drive shaft and an impeller shaft of the supercharger.

13. the supercharger drive device for the combustion engine as claimed in claim 10, wherein the supercharger includes a planetary gear assembly interposed between the impeller shaft and the drive shaft.

14. The supercharger drive device for the combustion engine as claimed in claim 13, wherein the planetary gear assembly includes an input shaft arranged parallel to the crankshaft.

* * * * *